US006533374B2

(12) United States Patent
Hightower

(10) Patent No.: US 6,533,374 B2
(45) Date of Patent: Mar. 18, 2003

(54) CLIPS FOR RESTRAINING FURNITURE DOORS FROM VERTICAL AND HORIZONTAL MOVEMENT DURING SHIPPING AND HANDLING

(75) Inventor: Robert C. Hightower, High Point, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 18 days.

(21) Appl. No.: 09/757,970

(22) Filed: Jan. 10, 2001

(65) Prior Publication Data

US 2002/0089269 A1 Jul. 11, 2002

(51) Int. Cl.[7] ..... E05C 19/10

(52) U.S. Cl. ..... 312/236; 292/145; 292/297; 312/257.1; 206/480

(58) Field of Search ..... 312/257.1, 265.1, 312/265.2, 265.4, 236, 271, 293.1, 293.2, 293.3; 108/158.1, 155, 156, 157.1, 158.12, 50.01, 59, 93; 292/145, 288, 326, 297; 206/600, 597, 477, 478, 480

(56) References Cited

U.S. PATENT DOCUMENTS 3,785,685 A * 1/1974 MacDonald et al. ..... 292/288
3,997,205 A 12/1976 MacDonald
4,019,764 A * 4/1977 Okamura ..... 292/288 X
4,531,670 A * 7/1985 Kupersmit ..... 229/45 X
4,707,870 A * 11/1987 Glassco et al. ..... 292/76 X
5,918,915 A * 7/1999 Calteux ..... 292/288 X
D439,832 S * 4/2001 Crooks et al. ..... 292/288 X

* cited by examiner

*Primary Examiner*—John G. Weiss
*Assistant Examiner*—Michael J. Fisher
(74) *Attorney, Agent, or Firm*—Myers Bigel Sibley & Sajovec

(57) ABSTRACT

Clips for restraining furniture doors from both vertical and horizontal movement during shipping and handling are provided. A clip includes an elongated base member having opposite first and second sides. A pair of elongated first and second panels extend outwardly from the base member first side in spaced-apart, opposing relationship. The first and second panels are configured to removably secure a portion of a furniture frame. An elongated third panel extends outwardly from the base member second side and is configured to engage an end portion of a furniture door and removably secure the door against the base member second side such that vertical and horizontal movement of the door relative to the frame is restrained.

7 Claims, 3 Drawing Sheets

CLIPS FOR RESTRAINING FURNITURE DOORS FROM VERTICAL AND HORIZONTAL MOVEMENT DURING SHIPPING AND HANDLING

FIELD OF THE INVENTION

The present invention relates generally to furniture and, more particularly, to devices for protecting furniture from damage during shipping and handling.

BACKGROUND OF THE INVENTION

Various types of furniture, such as cabinets and the like, have doors supported by hinges which permit pivotal movement thereof. Under normal usage, conventional furniture hinges may be adequate for supporting the weight of doors hung therefrom. However, during shipping or handling, furniture doors may swing open and may exert excessive loads on supporting hinges unless restrained in some manner. This tendency is particularly problematic for heavy doors such as those that include heavy glass windows therein.

Unfortunately, conventional furniture hinges (especially thin band hinges) may be insufficient to withstand forces encountered during shipping and handling, particularly vertical forces. The weight of a heavy door in combination with a sudden jolt may be sufficient to bend, dislocate and/or damage conventional furniture hinges.

Various devices are known for temporarily restraining furniture doors from lateral movement during shipping and handling. For example, U.S. Pat. No. 3,997,205 describes a cabinet door clip formed with a pair of U-shaped bends that are configured to limit lateral movement of a cabinet door.

FIG. 1A illustrates another prior art restraining clip 10 for restraining furniture doors from lateral movement during shipping and handling. The illustrated clip 10 is configured to engage an edge portion of a door and a frame member and to restrain the door from opening. The illustrated clip 10 includes a vertical segment 11, a portion 12 located at one end of the vertical segment 11 that is configured to engage a portion of a door 13, and a portion 14 located at the other end of the vertical segment 11 that is configured to engage a portion of a frame 15 when the door is closed. FIG. 1B illustrates the clip 10 of FIG. 1A in an installed configuration.

Unfortunately, the various known devices for temporarily restraining furniture doors during shipping and handling may not provide sufficient vertical (i.e., gravitational) support for a heavy door that is being restrained thereby.

SUMMARY OF THE INVENTION

In view of the above discussion, clips for restraining furniture doors from both vertical and horizontal movement relative to a frame during shipping and handling are provided. Clips according to embodiments of the present invention include an elongated base member having opposite first and second sides. A pair of elongated first and second panels extend outwardly from the base member first side in spaced-apart, opposing relationship. The first and second panels each have respective, opposite first and second sides and a free end. The first panel free end preferably includes a barb that is configured to removably secure a frame against the base member first side. Preferably, the barb is configured to apply a biasing force against a frame to retain the frame against the base member first side.

An elongated third panel extends outwardly from the base member second side, and includes opposite first and second sides and a free end. The third panel first side is configured to engage an end portion of a furniture door such that vertical movement of the door relative to the frame can be restrained. In addition, the third panel first side preferably includes a raised portion adjacent the third panel free end that is configured to removably secure a furniture door against the base member second side such that horizontal movement of the door relative to the frame can be restrained.

Clips according to embodiments of the present invention can be utilized to restrain vertical and horizontal movement of various types and configurations of furniture doors. Moreover, clips according to embodiments of the present invention can be manufactured economically using various inexpensive materials and known manufacturing techniques including, but not limited to, injection molding.

DETAILED DESCRIPTION OF THE INVENTION

Figure 1A:
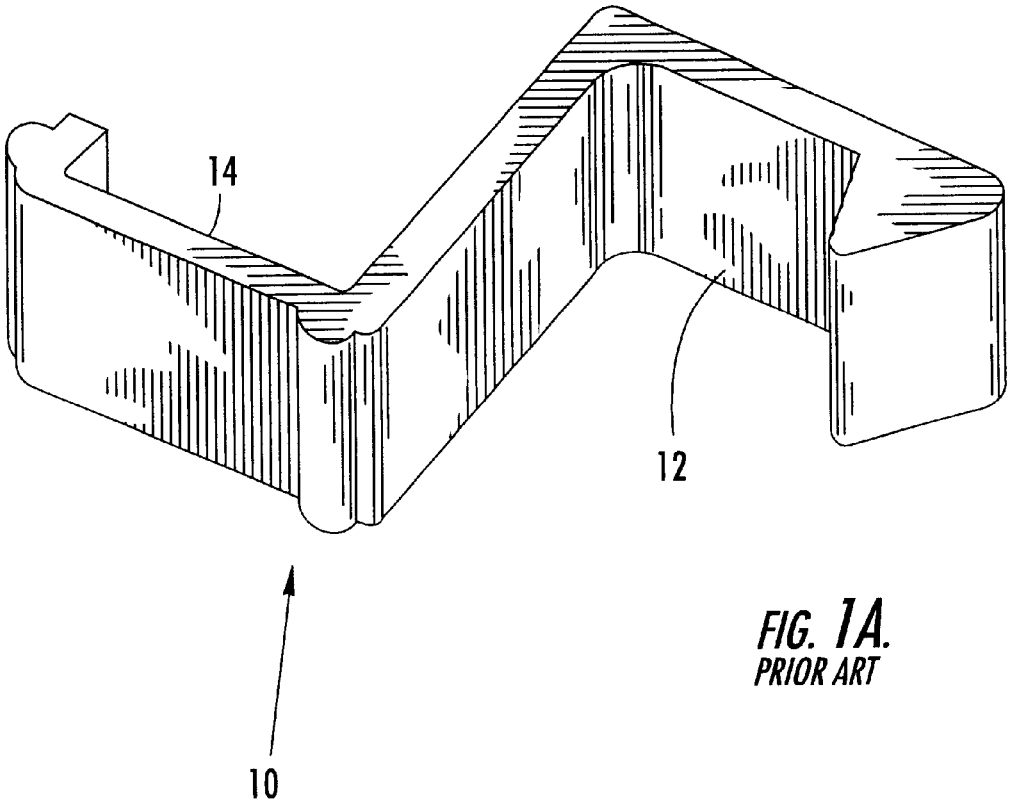
FIG. 1A. PRIOR ART
FIG. 1A is a perspective view of a prior art restraining clip for restraining furniture doors from opening during shipping and handling.
Figure 1B:
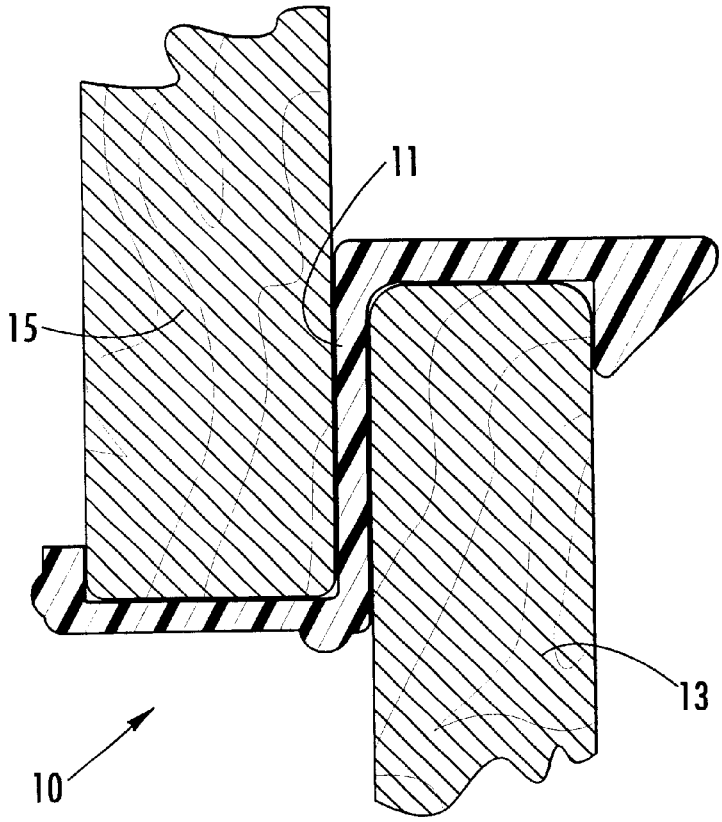
FIG. 1B. PRIOR ART
FIG. 1B illustrates the clip of FIG. 1A in an installed configuration.
Figure 2:
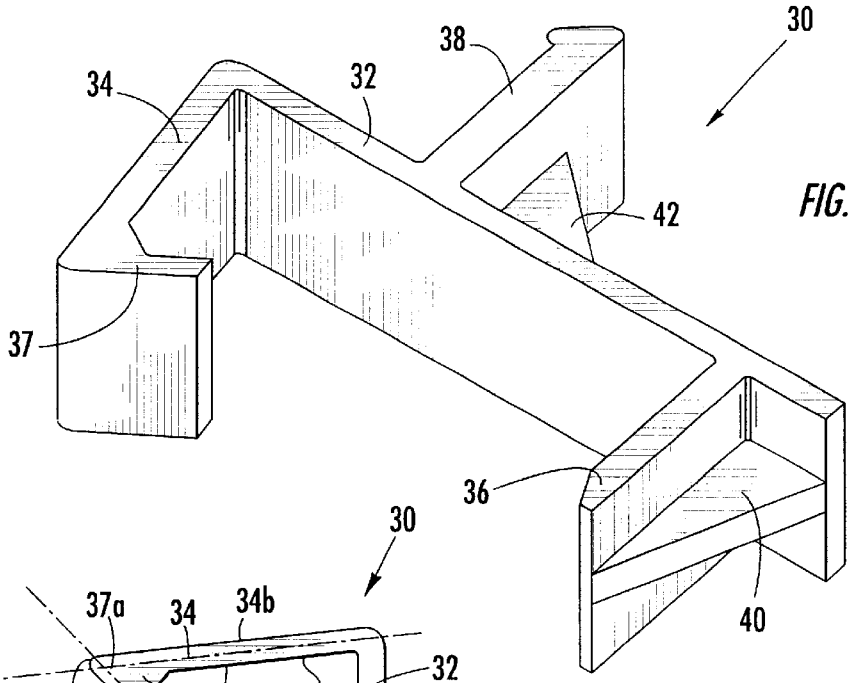
FIG. 2 is a perspective view of a restraining clip for restraining furniture doors during shipping and handling, according to embodiments of the present invention.
Figure 3:
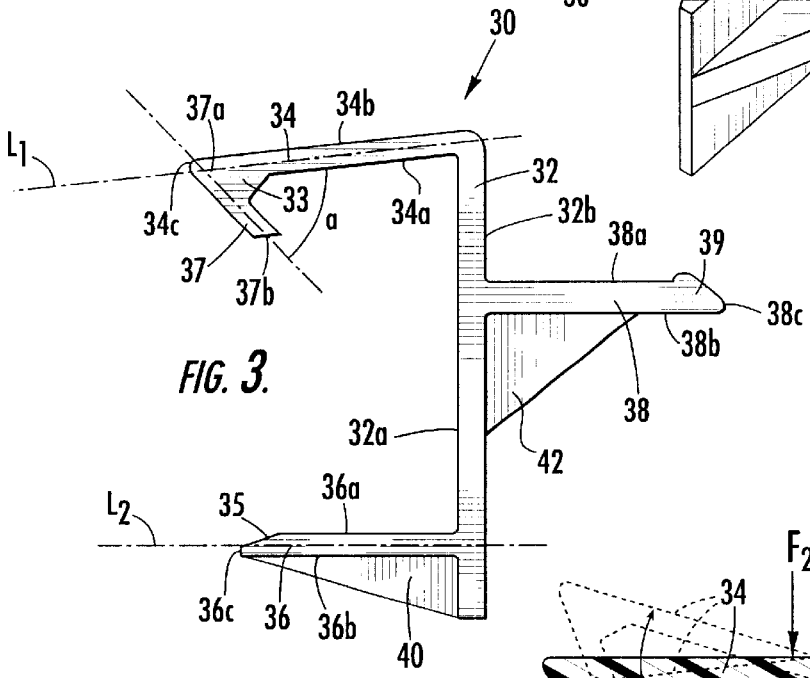
FIG. 3 is a side elevation view of the clip of FIG. 2 illustrating the clip in an uninstalled condition.
Figure 4:
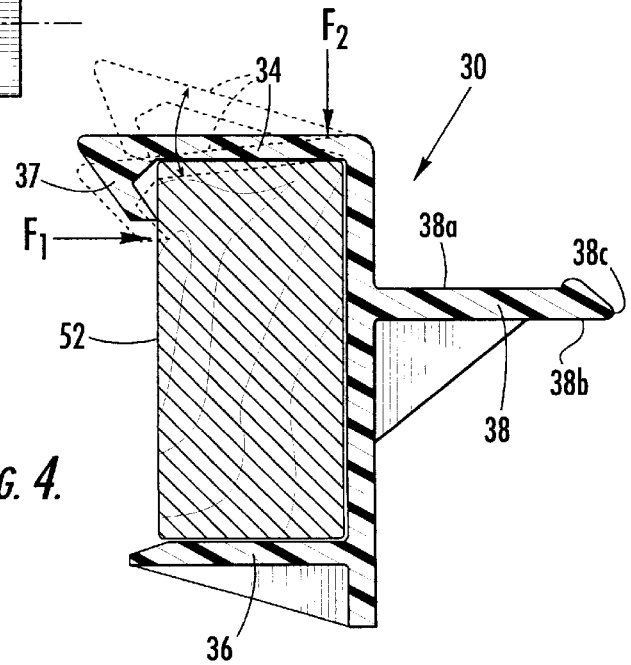
FIG. 4 illustrates the clip of FIG. 2 with a portion of a door frame removably secured between the first and second panels.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity.

Referring now to FIGS. 2–5, a clip 30 for restraining furniture doors from both vertical and horizontal movement during shipping and handling, according to embodiments of the present invention, is illustrated. The clip 30 includes an elongated base member 32 having opposite first and second sides 32*a,* 32*b.* A pair of elongated first and second panels 34, 36 extend outwardly from the base member first side 32*a* in spaced-apart, opposing relationship, as illustrated. The first panel 34 includes opposite first and second sides 34*a,* 34*b,* and a free end 34*c.* The second panel 36 includes opposite first and second sides 36*a,* 36*b,* and a free end 36*c.* The illustrated first panel free end 34*c* includes a barb 37 that is configured to removably secure the frame of an article of furniture (such as a cabinet) against the base member first side 32*a.*

The illustrated barb 37 includes an end 37*a* that is secured to the first panel 34, and an opposite free end 37*b* that extends from the first panel first side 34*a* in a direction toward the base member first side 32*a.* A reinforcing fillet 33 is provided between the barb 37 and the first panel first side 34*a* to provide additional rigidity to the barb 37 and to help prevent the barb 37 from breaking off from the first panel 34 when subjected to the loads experienced during the securing of a door. In the illustrated embodiment, the barb free end 37*b* extends from the first panel first side 34*a* at an angle a (FIG. 3) of between about 40 degrees and about 60 degrees.

In the illustrated embodiment, the first panel 34, in an uninstalled condition, extends outwardly from the base panel first side 32*a* in a direction $L_1$ that converges with the outwardly extending direction $L_2$ of the second panel 36. When a portion of a frame 52 (FIG. 4) is inserted between the first and second panels 34, 36, the first panel 34 bends away from the second panel 36 to allow the frame 52 to be inserted therebetween. As illustrated in phantom line in FIG. 4, the first panel 34 tries to return to its uninstalled (i.e., relaxed) condition, thereby causing the barb 37 to impart biasing forces $F_1$ and $F_2$ against the frame 52, which push the frame 52 against the base member first side 32*a* and the second panel 36.

In the illustrated embodiment, the second panel first side 36*a* has a tapered portion 35 adjacent the second panel free end 36*c.* Tapered portion 35 is designed to facilitate insertion of a frame between the first and second panels 34, 36. In the illustrated embodiment, a reinforcing member 40, in the form of a gusset, extends from the second panel second side 36*b* to the base panel first side 32*a.* The reinforcing member 40 is configured to provide additional strength and reduce deflection of the second panel 36 caused by movement of a frame in a direction toward the second panel 36. The reinforcing member 40 may have various configurations and shapes and is not limited to the illustrated embodiment.

An elongated third panel 38 extends outwardly from the base member second side 32*b,* as illustrated. The illustrated third panel 38 includes opposite first and second sides 38*a,* 38*b* and a free end 38*c.* The third panel first side 38*a* is configured to engage an end portion of a door such that vertical movement of the door relative to the frame is restrained. In the illustrated embodiment, the third panel first side 38*a* includes a raised portion 39 adjacent the third panel free end 38*c.* The raised portion 39 is configured to removably secure a door against the base member second side 32*b.*

In the illustrated embodiment, a reinforcing member 42, in the form of a gusset, extends from the third panel second side 38*b* to the base panel second side 32*b.* The reinforcing member 42 is configured to strengthen the third panel 38 and reduce deflection of the third panel 38 caused by movement of a door in a direction toward the third panel 38. The reinforcing member 42 may have various configurations and shapes and is not limited to the illustrated embodiment.

Clips 30 according to embodiments of the present invention can be manufactured from various materials and via various processes. Exemplary materials include, but are not limited to, polyethylene and polypropylene, and an exemplary manufacturing method includes, but is not limited to, injection molding.

Figure 5:
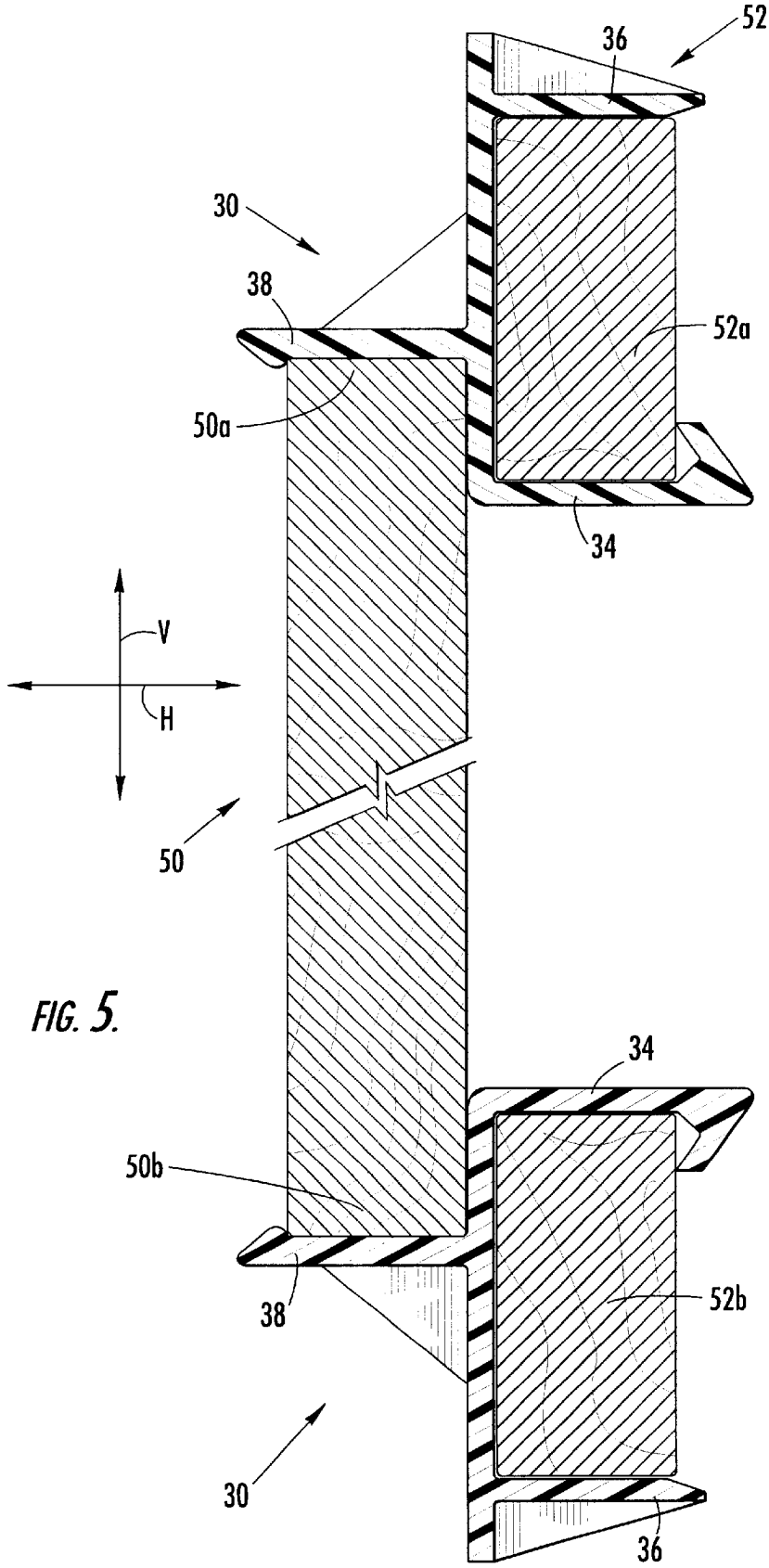
FIG. 5 illustrates a pair of clips according to the embodiment of FIG. 2, wherein one clip is secured to a top portion of a door and to an adjacent door frame portion, another clip is secured to a bottom portion of the door and to an adjacent door frame portion, and both clips restrain the door from both vertical and horizontal movement relative to the frame.

Referring now to FIG. 5, clips 30 according to embodiments of the present invention are illustrated in an installed configuration on an article of furniture, such as a cabinet. A first clip 30 is secured to an upper end portion 50*a* of a vertically hung furniture door 50, and to an adjacent upper frame portion 52*a* as illustrated. A second clip 30 is secured to a lower end portion 50*b* of the vertically hung furniture door 50, and to an adjacent lower frame portion 52*b* as illustrated. The respective clips 30 restrain the vertically hung door 50 in both vertical and horizontal directions indicated by arrows V and H.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A clip for securing a door in a closed position relative to a frame, the clip comprising:

an elongated base member, comprising opposite first and second sides;

a pair of elongated first and second planar panels extending outwardly from the base member first side in spaced-apart, opposing relationship, wherein the first and second planar panels each comprise opposite first and second sides and a free end, wherein the first planar panel free end comprises a barb having a free end positioned between the first and second planar panels that is configured to removably secure a portion of the frame positioned between the first and second planar panels against the base member first side, and wherein the first planar panel extends outwardly from the base member first side in a first direction that converges with an outwardly extending second direction of the second planar panel; and an elongated, planar third panel extending outwardly from the base member second side, wherein the third planar panel comprises opposite first and second sides and a free end, wherein the third planar panel first side is configured to engage an end portion of the door, and wherein the third planar panel first side includes a raised portion adjacent the third planar panel free end that is configured to removably secure the door against the base member second side such that vertical and horizontal movement of the door relative to the frame is restrained.

2. The clip according to claim 1, further comprising a reinforcing fillet between the barb and the first planar panel first side.

3. The clip according to claim 2, wherein the barb free end extends from the first planar panel first side at an angle of between about 40 degrees and about 60 degrees with respect to the first planar panel first side.

4. The clip according to claim 1, wherein the second planar panel free end is tapered.

5. The clip according to claim 1, further comprising a reinforcing member extending from the third planar panel second side to the base panel second side, wherein the reinforcing member is configured to reduce deflection of the third planar panel caused by movement of the door.

6. The clip according to claim 1, further comprising a reinforcing member extending from the second planar panel second side to the base panel first side, wherein the reinforcing member is configured to reduce deflection of the second planar panel caused by movement of the frame.

7. The clip according to claim 1, wherein the base member, and first, second, and third planar panels comprise polyethylene.

* * * * *